US005119954A

United States Patent [19]

Svyatsky et al.

[11] Patent Number: 5,119,954

[45] Date of Patent: Jun. 9, 1992

[54] MULTI-PASS SORTING MACHINE

[75] Inventors: Eduard M. Svyatsky, Libertyville; George Paroubek, Downers Grove; Frederick P. Hegland, Des Plaines, all of Ill.

[73] Assignee: Bell & Howell Company, Skokie, Ill.

[21] Appl. No.: 501,556

[22] Filed: Mar. 29, 1990

[51] Int. Cl.[5] ..... B07C 5/36; B65H 85/00

[52] U.S. Cl. ..... 209/584; 209/900; 271/3.1; 271/9; 271/35; 271/122; 271/181; 271/286; 414/798.2

[58] Field of Search ..... 209/3.1–3.3, 209/554, 563, 564, 583, 584, 900; 271/2, 3, 3.1, 4, 9, 10, 35, 122, 181, 272, 285, 286; 414/798.2

[56] References Cited

U.S. PATENT DOCUMENTS

| | | | |
|---|---|---|---|
| 3,184,061 | 5/1965 | Levy | 209/900 X |
| 3,261,464 | 7/1966 | Levy | 209/933 X |
| 3,351,217 | 11/1967 | Sassen et al. | 414/798.2 X |
| 3,378,251 | 4/1968 | Donabin | 271/186 X |
| 3,757,939 | 9/1973 | Henig | 209/900 X |
| 3,782,541 | 1/1974 | Wood | 209/584 |
| 3,865,365 | 2/1975 | Hardin et al. | 271/214 |
| 3,918,704 | 11/1975 | Sugiyama et al. | 271/215 X |
| 4,051,957 | 10/1977 | Parups | 271/305 X |
| 4,273,491 | 6/1981 | Roux | 271/214 X |
| 4,482,059 | 11/1984 | Horii et al. | 209/569 |
| 4,503,977 | 3/1985 | Kohno et al. | 209/584 X |
| 4,518,160 | 5/1985 | Lambrechts et al. | 271/214 |

FOREIGN PATENT DOCUMENTS 2724284 12/1978 Fed. Rep. of Germany ..... 271/214

*Primary Examiner*—Michael S. Huppert
*Assistant Examiner*—Edward M. Wacyra
*Attorney, Agent, or Firm*—Welsh & Katz, Ltd.

[57] ABSTRACT

A mail document sorting device includes a document input feeder, and at least one singulation device for orienting and singulating the documents so that indicia on their faces can be disposed at a predetermined level about a data reference plane. Single documents pass to an indicia reader, which generates indicia indicating signals. An electronic/computer mechanism processes the indicating signals, and provides for sorting the read documents into bins. A plurality of the bins is located in side-by-side horizontal array, with an elongated belt disposed along the array of bins for moving documents received therefrom. The elongated belt has an inboard edge adjacent the array of bins and an outboard edge remote from the array of bins. The sorting device further includes a mechanism for moving documents from the bins onto the elongated belt, locating device associated with the elongated belt for positioning an edge of documents on the elongated belt, a shingler for shingling documents received from the elongated belt, transport of the shingled documents as they are discharged from the shingler means, and loading received shingled documents sequentially into mail trays.

38 Claims, 6 Drawing Sheets

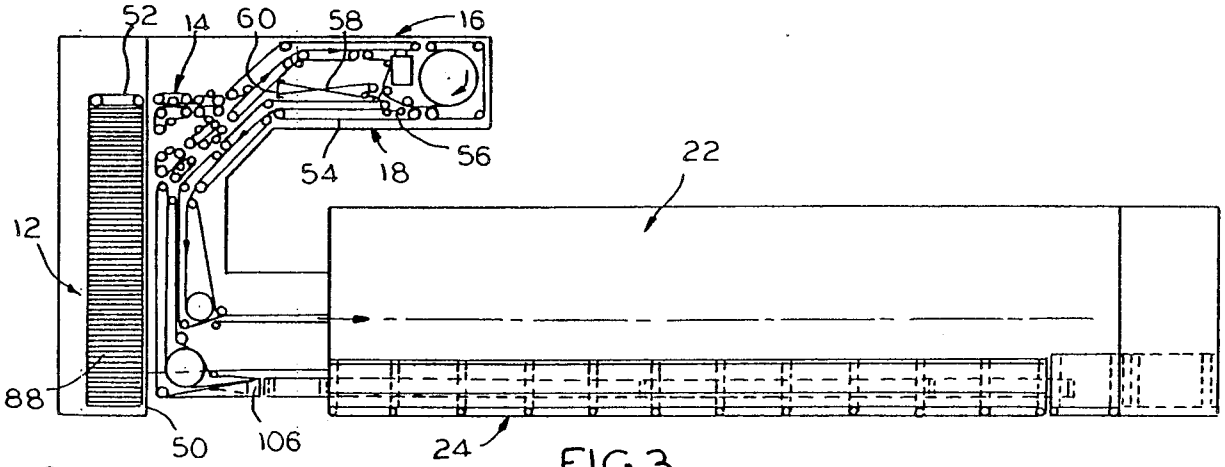
FIG.3
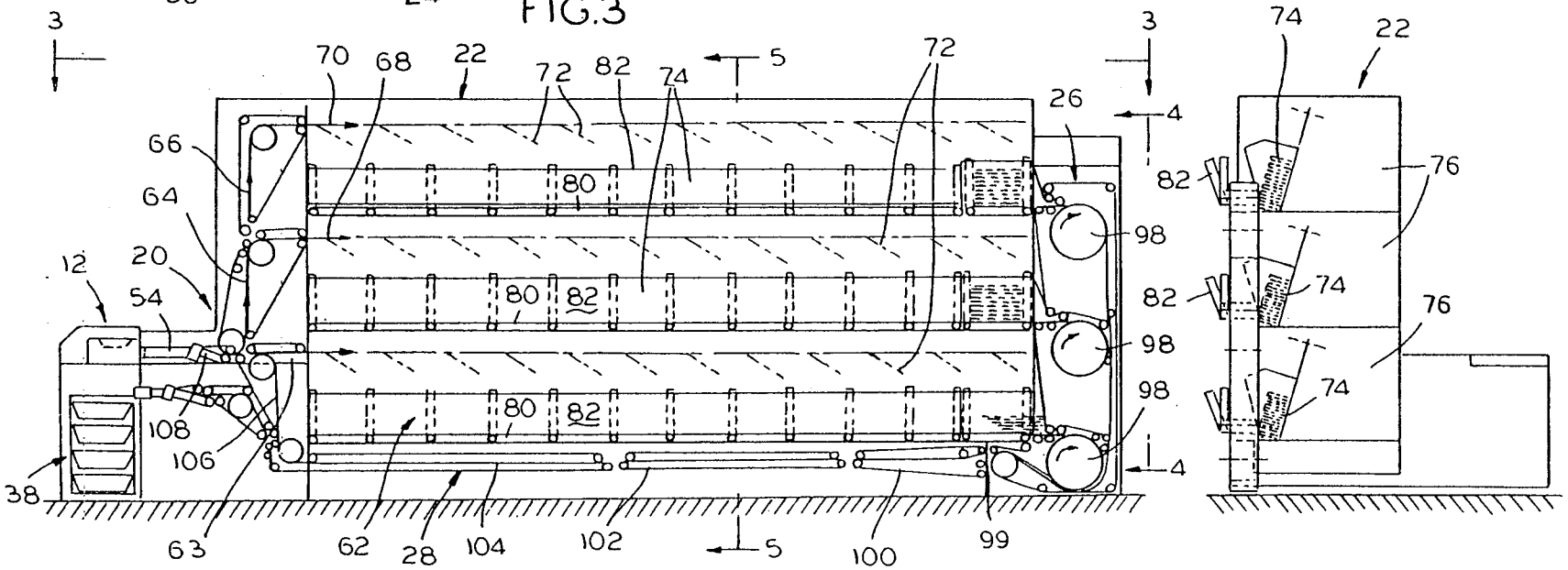
FIG.4
FIG.2

MULTI-PASS SORTING MACHINE

FIELD OF THE INVENTION

This invention relates to a sorting machine for use in the sequential sorting of mail identified for delivery by an individual carrier. In an urban area there are generally in excess of three thousand pieces of mail and over one thousand delivery points for each daily individual carrier delivery route. The time for sequencing of mail in pouch (actually fibre-board mail trays) for an individual carrier can be measured in a reduction of several hours when the sorting machine contemplated by the present invention is utilized.

The theory of operation of the present invention is to utilize a two-pass system for the delivery sequence sortation of mail handled by the local carrier. The two-pass method of sortation described herein can be used for both the 33 sort stacker and the 66 sort stacker Carrier Sequence Bar Code Sorter (hereinafter referred to as CSBCS and where the term "Sequence" relates to the sequential arrangement of the stops on a single carrier's delivery route).

This two-pass sortation system was devised to allow for a delivery sequencing of mail using a minimum number of sort stackers to give the maximum number of sortation separations. The two-pass system requires that all mail pieces fed into the CSBCS, for a particular carrier sort run, be read by the CSBCS bar code reader twice The initial reading of the bar code (the "1st Pass") will occur as an operator feeds the mail pieces into the CSBCS. After all mail has been fed by the operator, and sorted to the sort stackers, the CSBCS will automatically recirculate the mail, using the correct sort stacker sequence, past the bar code reader a second time (giving the "2nd Pass"). The mail will again be sorted to the sort stackers, at which point the mail will be in proper delivery sequence. Described herein is a two-pass sortation system using 33 stackers for both the first and second passes of mail. While this is the system given as the illustrative embodiment, any future production machines may require an expansion on the number of sort stackers used for this illustrative embodiment, to allow for an increased number of sortation separations. Any sort program generation of programs for the CSBCS using the two-pass system, must be configured to allow an expansion of the number of sort stackers, without drastic changes to existing sort programs.

In a two-pass system, the CSBCS will use the first pass of mail to distribute mail pieces in such a manner that when the mail is processed through a second pass, and each sort stacker buffer (containing mail from the first pass) is processed in sequence, the mail will be in the proper delivery sequence. A system that uses 33 sort stacker buffers for the first pass and 33 sort stacker buffers for the second pass is referred to as a Module 33 system. Similarly, if the system is expanded to include 50 sort stacker buffers, then it is a Module 50 system.

BACKGROUND OF THE INVENTION

Attempts have been made to provide sorters for use by individual carriers. However, since the theory of sorting utilized in such equipment required multiple passes it was necessary for the carrier to manually remove sorted material from bins (called "sweeping") and return the sorted letters back to the original sorting apparatus. This was not only cumbersome but also often resulted in breakdown of the sort and hence would require another first or second sort on the disassembly of the order of the sorted letters.

OBJECTS AND THEORY OF THE PRESENT INVENTION

The theory of operation of the present invention is to utilize a two-pass system for the delivery sequence sortation of mail handled by the local carrier. The two-pass method of sortation described herein can be used for both a 33 sort stacker and the 66 sort stacker Carrier Sequence Bar Code Sorter (hereinafter referred to as CSBCS and where the term "Sequence" relates to the sequential arrangement of the stops on a single carrier's delivery route).

This two-pass sortation system was devised to allow for a delivery sequencing of mail using a minimum number of sort stackers to give the maximum number of sortation separations. The two-pass system requires that all mail pieces fed into the CSBCS, for a particular carrier sort run, be read by the CSBCS bar code reader twice. The initial reading of the bar code (the "1st Pass") will occur as an operator feeds the mail pieces into the CSBCS. After all mail has been fed by the operator, and sorted to the sort stackers, the CSBCS will automatically recirculate the mail, using the correct sort stacker sequence, past the bar code reader a second time(giving the "2nd Pass"). The mail will again be sorted to the sort stackers, at which point the mail will be in proper delivery sequence. Described herein is a two-pass sortation system using 33 stackers for both the first and second passes of mail. While this is the system given as the illustrative embodiment, any future production machines may require an expansion or a reduction on the number of sort stackers used for this illustrative embodiment, to allow for an increased or decreased number of sortation separations, as circumstances require. Any sort program generation of programs for the CSBCS using the two-pass system, must be configured to allow an expansion of the number of sort stackers, without drastic changes to existing sort programs.

In a two-pass system, the CSBCS will use the first pass of mail to distribute mail pieces in such a manner that when the mail is processed through a second pass, and each sort stacker (containing mail from the first pass) is processed in sequence, the mail will be in the proper delivery sequence. A system that uses 33 sort stacker buffers for the first pass and 33 sort stacker buffers for the second pass is referred to as a Module 33 system. Similarly, if the system is expanded to include 50 sort stacker buffers, then it is a Module 50 system. The following is a simplistic example of a two-pass system. Although this example uses four sort stackers for the first pass and thirteen sort stackers for the second pass, as opposed to the required 33 sort stackers for the first pass and 33 for the second pass, as mentioned above, the theory is still the same.

An operator who wishes to can use the CSBCS to sort a deck of playing cards (52 cards, excluding Jokers) by number, then color, and then icon in just two passes. After the two-pass sort, the desired order is:

#1. 2 of Diamonds (red), 2 of Hearts (red), 2 of Clubs (black), and then the 2 of Spades (black):

#2. 3 of Diamonds (red), 3 of Hearts (red), 3 of Clubs (black), and then the 3 of Spades (black); . . . etc. (4–10, J,Q, K,) up to . . .

#13. Ace of Diamonds (red), Ace of Hearts (red), Ace of Clubs (black), and then the Ace of Spades (black).

The Operator feeds a shuffled deck of cards into the CSBCS, which in turn sorts (first pass) all Diamonds (red) to the first sort bin, all Hearts (red) to the second sort bin, all Clubs (black) to the third sort bin, and all Spades (black) to the fourth sort bin. After all 52 cards have been sorted through the first pass, the CSBCS automatically recirculates the cards (hence the second pass) to a second set of 13 sort bins. During the second pass, the CSBCS processes all cards in the first sort bin (of the initial set of four sort bins) and distributes the 2 of Diamonds to the first sort bin, the 3 of Diamonds to the second sort bin, etc. up to the Ace of Diamonds to the Thirteenth sort bin. Similarly, after all cards from the first sort bin have been processed a second time, the CSBCS will process all cards contained in the second sort bin (Hearts), and distribute the cards (in the same manner as for the second pass for Diamonds) on top of the Diamonds to the set of thirteen sort stackers. The CSBCS will continue to process the second pass with sort bin #3 (Clubs) and then sort bin #4 (Spades) until all cards from the initial set four stackers have been properly sorted to the set of thirteen stackers. After the second pass is complete, the CSBCS automatically unloads the cards from the second set of thirteen stackers, with bin #1 first, then bin #2, etc., through bin #13 last, to an output stacker. All the operator need do is pick up the 52 cards, now in the desired order, from the output stacker.

There is not much difference between this card sort example, and a two-pass system used to sort a carrier's mail into delivery walk sequence. In the sort card example, the CSBCS uses 4 sort stackers and, then 13 sort stackers to sequence the cards, and this allows for $4\times13=52$ possible separations. Similarly, a two-pass system that uses 33 sort stackers and then 33 sort stackers to sequence mail, gives $33\times33=1089$ possible separations. This two-pass system for carrier sequencing would look as follows:

After the first pass, mail will be distributed to the 33 sort stackers so that, sort bin #1 contains all mail for the 1st, 34th, 67th . . . through 1057th delivery stop, sort bin #2 contains all mail for the 2nd, 35th, 68th . . . through . . . 1058th delivery stop, . . . etc., through sort bin #33, which contains all mail for the 33rd, 66th, 99th . . . through the 1089th delivery stop.

After the first pass is complete, a second pass of mail will be performed. During the second pass the CSBCS will sort all of the mail from sort bin #1 first then all of the mail from sort bin #2 next, etc., in bin sequence, ending with sort bin #33. After the second pass, mail will be distributed to the 33 stackers such that, second pass sort bin #1 will contain all of the mail for the 1st delivery point on top of which will be all of the mail for the 2nd delivery point, etc. up to all of the mail for the 33rd delivery, second pass sort bin #2 will contain all of the mail for the 34th delivery point on top of which will be all of the mail for the 35th delivery point, etc., up to all of the mail for the 66th delivery, . . . etc., through second pass sort bin #33, which will contain all of the mail for the 1057th delivery point on top of which will be all of the mail for the 1058th delivery point, . . . etc., up to all of the mail for the 1089th delivery point.

The basic approach of the present invention is to utilize belt means for controlled machine handling of all of the mail, to eliminate all operator handling or sweeping, between the initial manual introduction into an input feed and singulation means until the mail is sorted in the desired sequential relation and automatically fed into mail trays for loading into the delivery vehicle or carrier bag.

The actual sorting is accomplished by a bar code reader and associated electronics and computer chip means. The bar code reader (BCR) reads the whole 11-digit code and then translates the code into a number from 1 to 1089, each number of which identifies a separate delivery point or stop, which bears no relation to the zip code. The individual postman carrier determines how he wants to deliver and he establishes his own route and determines the stop numbers. And after he has picked the sequence of numbers that come out after sorting, the post office assigns one of the numbers from 1 to 1089 to each stop. The eleven digit zip code is placed on the envelope by the post office and is obtained from a national look-up directory, with another machine adding the eleven digit zip to the envelope. The present 9-digit zip code gets you to one side of a particular block on a particular street, while the 11-digit zip code gets you directly to a particular stop or house. The stop numbers assigned by the postman permit him to go back and forth across a street or to follow one side of the street, according to his own personal preference for delivery. Thus, the zip codes serve the function of directing the mail to a particular sub-station, while the sequence of stop numbers are representative of the personal wishes of a particular carrier in relation to the stop points assigned to him. The equipment contemplated by the present invention utilizes an indicia reader, either bar code or character, to read the bar code and then, through electronic and/or computer means, assigns a stop number for sorting purposes.

DESCRIPTION OF DRAWINGS

FIG. 2 is a front elevation view of the device shown in FIG. 1;

FIG. 3 is a top plan view of the device as taken along line 3—3 in FIG. 2;

FIG. 4 is an end elevational view of the device as taken along line 4—4 in FIG. 2;

DETAILED DESCRIPTION

Figure 1:
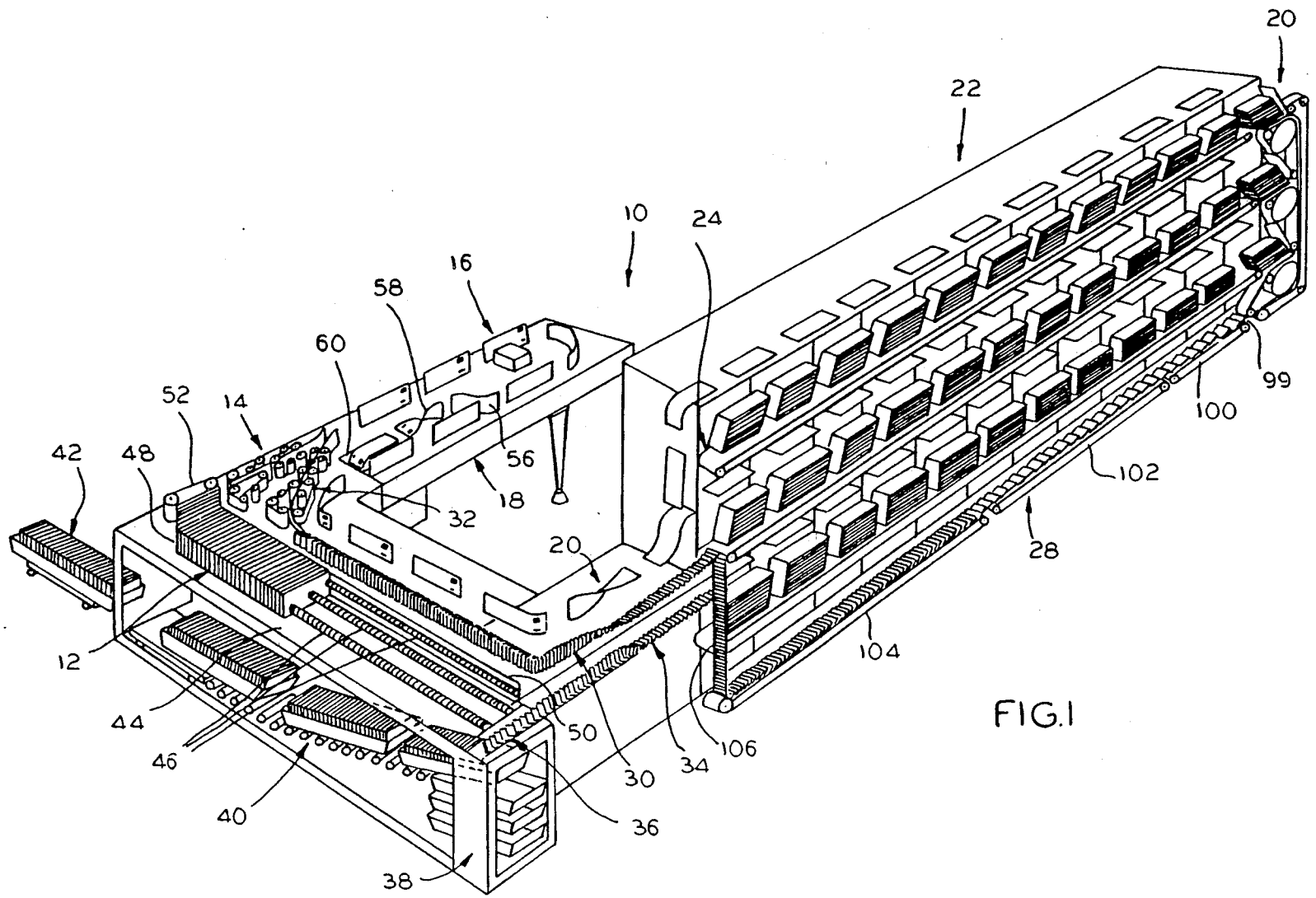
FIG. 1 is schematic perspective view of a sorting machine embodying the teachings of the present invention.

Referring now to the drawings, wherein similar parts are designated by similar numerals, and particularly to FIG. 1, the system contemplated by the present invention is embodied in the sorter 10. Such a sorter 10 includes a document input feed means 12, a first pass singulation means 14, indicia reading means 16, separation and segregation means 18, orientation and conversion means 20, sorter mechanism 22, belt discharge mechanism 24, shingler means 26, shingled document transport means 28, flow path 30 for orienting shingled documents for the second pass, second pass singulation means 32 for second pass reading by indicia reading means 16, discharge path 34 for vertically orienting second pass sequentially sorted documents, loading means 36 for sequentially sorted documents, tray elevation means 38, conveyor rollers 40 for filled mail trays; and a discharged tray on dolly 42.

The document input feed means 12 follows a normal pattern for such devices. In this embodiment, an elongated generally planar tray means 44 includes a trio of auger type means 46, with two such means 46 underlying the edge-stacked letters 48 and a third means 46 extending along a vertical sidewall 50 against which the end edge of the vertical envelopes 48 are abutted. The first or lead letter is moved laterally from the front of the stack by belt means 52 to deliver such lead letter to the singulator 14 which can be one of several designs for such purposes. Such singulators insure that only a single letter is withdrawn sequentially from the front of the stack 48 settled to the plane of the belt surface that it is riding on, and then singly presented to the indicia reading means 16 for either bar code or character reading and signal generation for sorting purpose identification. The signal is transmitted to electronic/computer chip means, not shown.

As best seen in FIGS. 1–3, the letters are then fed by belt means 54 (FIGS. 2 and 3), if acceptable, or if not identifiable, the letters are diverted by means 56 (FIGS. 1 and 3), translated by means 58 to a flat position (FIGS. 1 and 3), and discharged by means 60 (FIGS. 1 and 3) through an opening to a container means below, not shown. The belt system 54 continues around to the orientation and conversion means 20 which, as best seen in FIG. 2, segregates and diverts the identified mail either directly ahead via belt means to the lower tier of bins 62, or upwardly by belt means 64 to the center tier of bins 68, or further upwardly by belt system 66 to the top tier of bins 70. The signal generated by the indicia reading means 16 as interpreted by the electronic/computer means, not shown, directs the particular letter by proper signal instructions to the correct belt means 63, 64, or 66. The electronic/computer means also supplies the necessary signals for operation of the diverter or gate means 72 which are shown in phantom above each individual bin 74 within the tiers of bins 62, 68 and 70 in the sorter 22.

Figure 5:
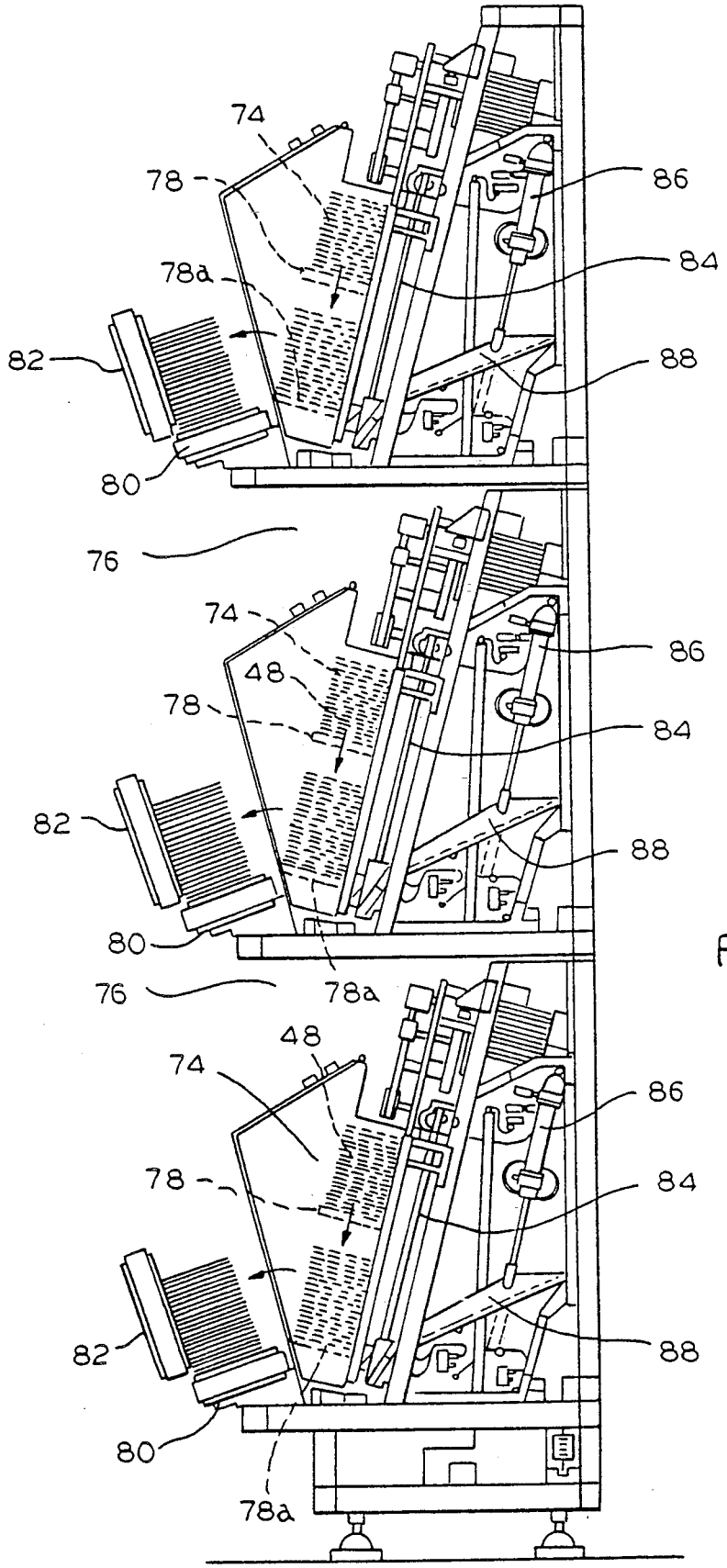
FIG. 5 is a schematic cross-sectional elevational view of the bin discharging mechanism as taken generally along line 5—5 of FIG. 2.

Each bin 74 is located within a chamber 76 within sorter 22, this being best illustrated in FIGS. 4 and 5. As the letters are distributed to the various bins 74, the letters 48 are positioned on a cantilever shelf-like member 78. When the shelf 78 reaches a maximum supporting capacity, it is lowered hydraulically to the lower position designated 78*a*.

Positioned in front of each row of chambers 76 are a pair of normally disposed belts, 80 and 82, with the lower belt 80 being transversely disposed in an outwardly and downwardly extending angled relationship relative to the bins 74. The second belt 82 extends upwardly substantially perpendicular to the outside edge of belt 80. These belts run the entire length of the sorter 22 and terminate at the far end (or right hand end in the drawings) at a shingler means 26, as will be further described hereinafter.

The shelves 78 in the bins 74 are moved up and down by screw means 84. When the shelves 78 are full they are tipped out of the chamber 76, as seen by the arrows in FIG. 5, and the stack of letters 48 is thereby dumped as a stack onto the lower belt 80 with the outer edge of the letters 48 abutting and supported by belt 82. The tipping of the lowered shelf 78*a* is accomplished by the hydraulic means 86 and its attached lever system 88.

Figure 7:
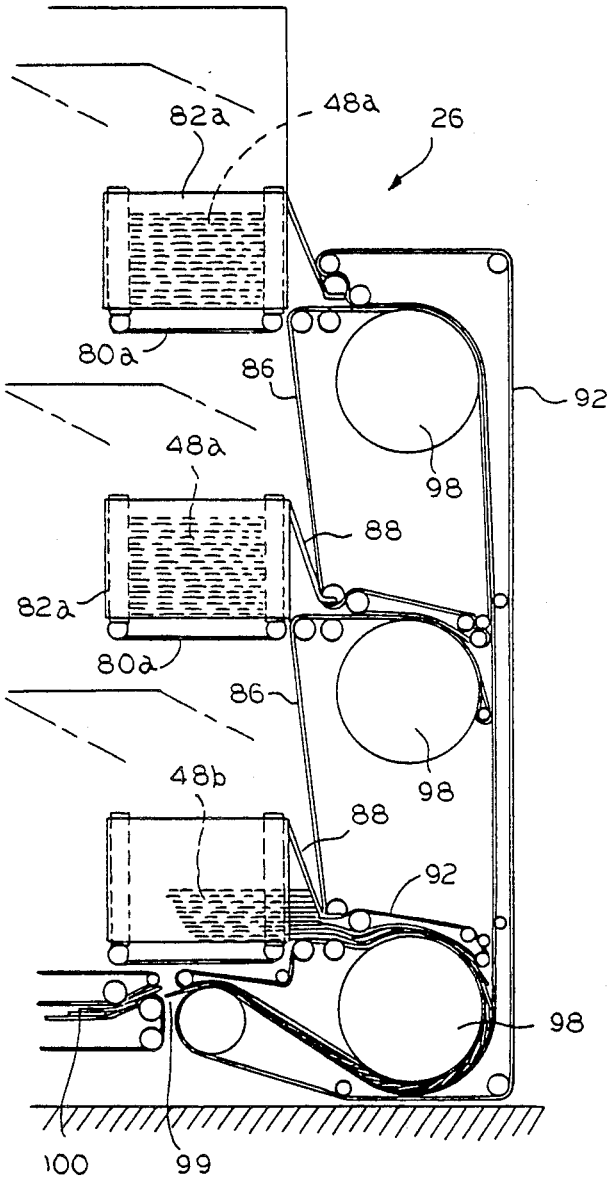
FIG. 7 is an enlarged partial view of the right hand end of the view shown in FIG. 2, showing the shingler stations for the three tiers of bins.
Figure 6:
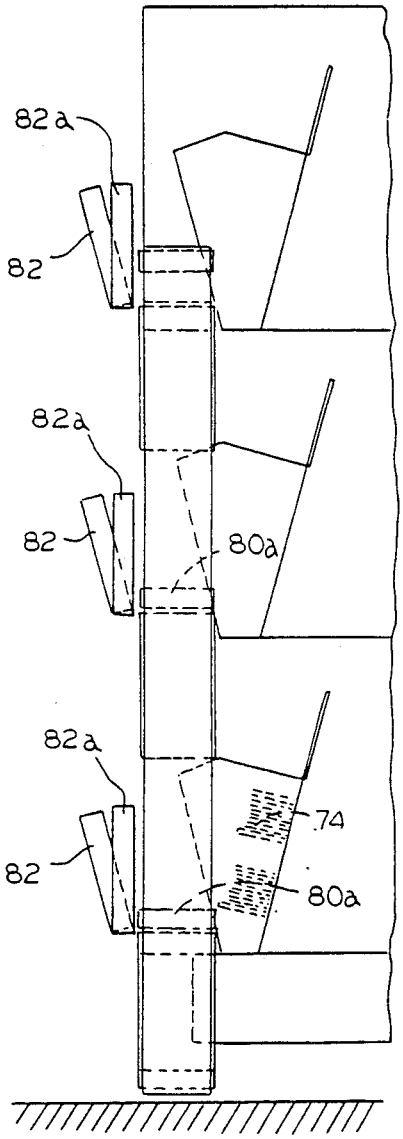
FIG. 6 is an enlarged partial view of FIG. 4.

As the stack contents of individual bins 74 are discharged onto the belt 80, they are moved to the far or right end, as seen in FIGS. 1 and 2, and are brought into position for action by the shinglers 26. As seen in FIGS. 6 and 7 each load of stacked letters abutting a vertically angled outer belt 82 is brought into a positive vertical disposition by engaging a short belt 82*a*, and as this load is carried on the horizontally angled lower belt 80, it is brought into a thru horizontal disposition by being transferred to a short belt 80*a* so that the stack of letters 48*a* is squared relative to the action of shingler 26.

Figure 10:
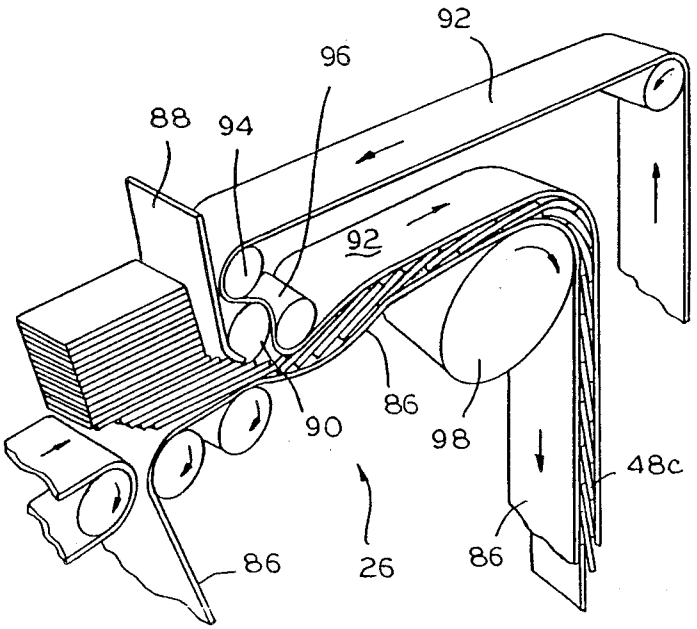
FIG. 10 is a perspective view from the upper left position relative to the partial view of the device shown in FIG. 8.
Figure 8:
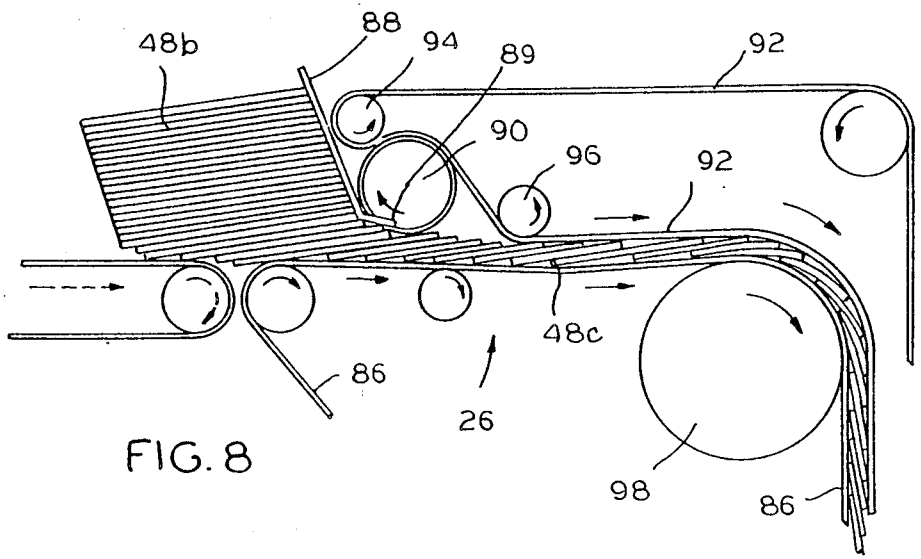
FIG. 8 is a schematic partial elevational sectional view of the shingler mechanism.
Figure 9:
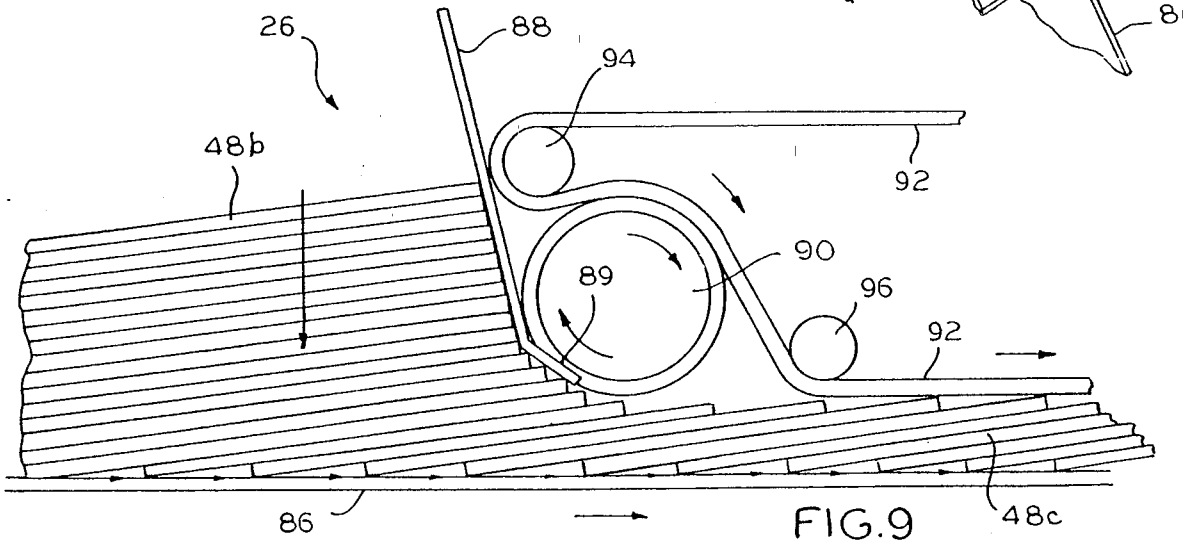
FIG. 9 is an enlarged detail view of a portion of the mechanism shown in FIG. 8.

As best seen in FIGS. 8–10, the bin load 48*a*, (shown vertically stacked in FIG. 7) is moved by belt 80*a* until the forward end of said load 48*a* engages belt 86 and is drawn into a slanting configuration 48*b* by the action of long belt 86 and the reversely slanted guide 88. Guide 88 is curved away, as at 89 in FIG. 9, from the stack 48*b* and slotted to accommodate enlarged roller 90. Roller 90 is rotating in opposition to the ejection of letters from under the guide 88 and measures the amount of letters permitted to be ejected. While the belt 86 supports the lower side of the letters 48*b*, a belt 92 engages the upper side of roller 90 and the under side a wrap-around side of rollers 94 and 96 to thereby grip the upper side of the shingled stream of letters 48*c*. This permits the stream 48*c* to be drawn over the enlarged roller 98 and moved vertically downwardly until the stream is ejected from the shingler mechanism at 99 (in FIGS. 1 and 2) for transportation on belt systems 100, 102, and 104. As seen most clearly in FIG. 2, belt systems 100, 102, and 104 each comprise a pair of belts for holding the shingled letters therebetween. Further upward transportation of the shingled letters is achieved by belt system 106 for translation at 108 by means 30 for a second pass by then going through the second pass singulator 32 where the letters are positioned singly and properly for a further second pass reading by the indicia reading means 16.

After the letters have gone through the second pass and sorting procedure, the bins are sequentially emptied onto the belts 80 and 82, and the stacked letter are shingled for transportation from the tiers of bins. Referring now to FIGS. 11–14, sequentially the shingled letters 48*c* are fed through the angularly reorienting mechanism 34 (FIG. 1) and fed off of a laterally extending belt means 110 (FIG. 13) into the upper mail tray 112. When the tray 112 is, filled the gate 142 (FIG. 12) is opened and tray 112 rolls down the roller conveyor 40 to a waiting dolly 42. An empty tray 116 is introduced at the lower end of tray raising means 38 after the mechanism has raised the other two empty trays 118 and 120.

Figure 12:
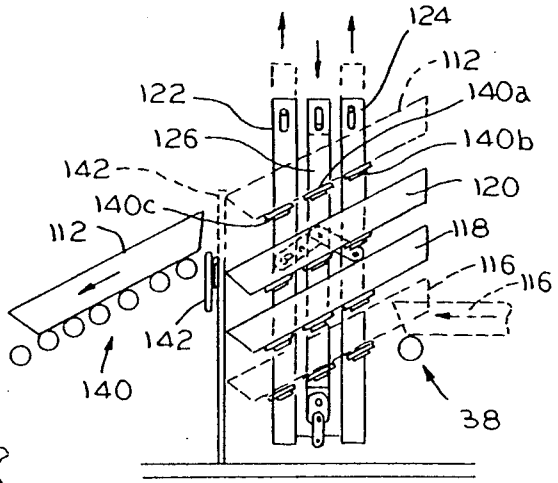
FIG. 12 is a schematic partial cross-sectional elevation view of the tray positioning mechanism utilized in the mail tray loading means of FIG. 11.
Figure 13:
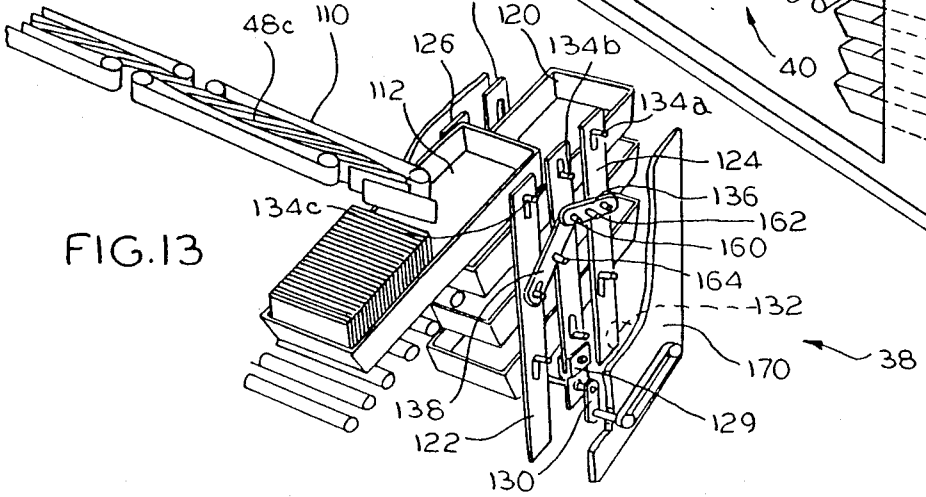
FIG. 13 is an exploded perspective view of the tray positioning mechanism shown in FIG. 12 along with the mechanism for shingled delivery of mail into a mail tray.

As best seen in FIG. 13, the tray raising mechanism 38 includes a plurality of parallel slideable strips 122 and 124 on the outboard positions and central strip 126 intermediate the other two. The central strip 126 is equipped at its lower end with a yoke means 129, a bell crank 130 and a power means 132. When the bell crank 130 causes the central strip to move downwardly, as best seen in FIG. 12, the outboard strips 122 and 124 are caused to move upwardly by reason of the linkage arms 136 and 138 (FIG. 13) centrally pivotably hinged as at 160. The pivot pins 162 and 164, along with the pins 134*a*, 134*b*, and 134*c* are fixed to the sidewall 170 of the structure, whereby when the pivot 160 is pulled downwardly by the central strip 126, the outer free ends of linkage arms 136 and 138 are caused to move upwardly and thereby casing the outboard arms 122 and 124 to also move upwardly, as seen in the drawing.

Figure 14:
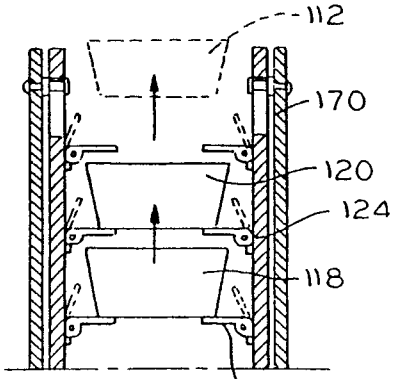
FIG. 14 is a schematic partial cross-sectional elevational view of the movable support means utilized in the tray positioning mechanism shown in FIGS. 12 and 13.
Figure 11:
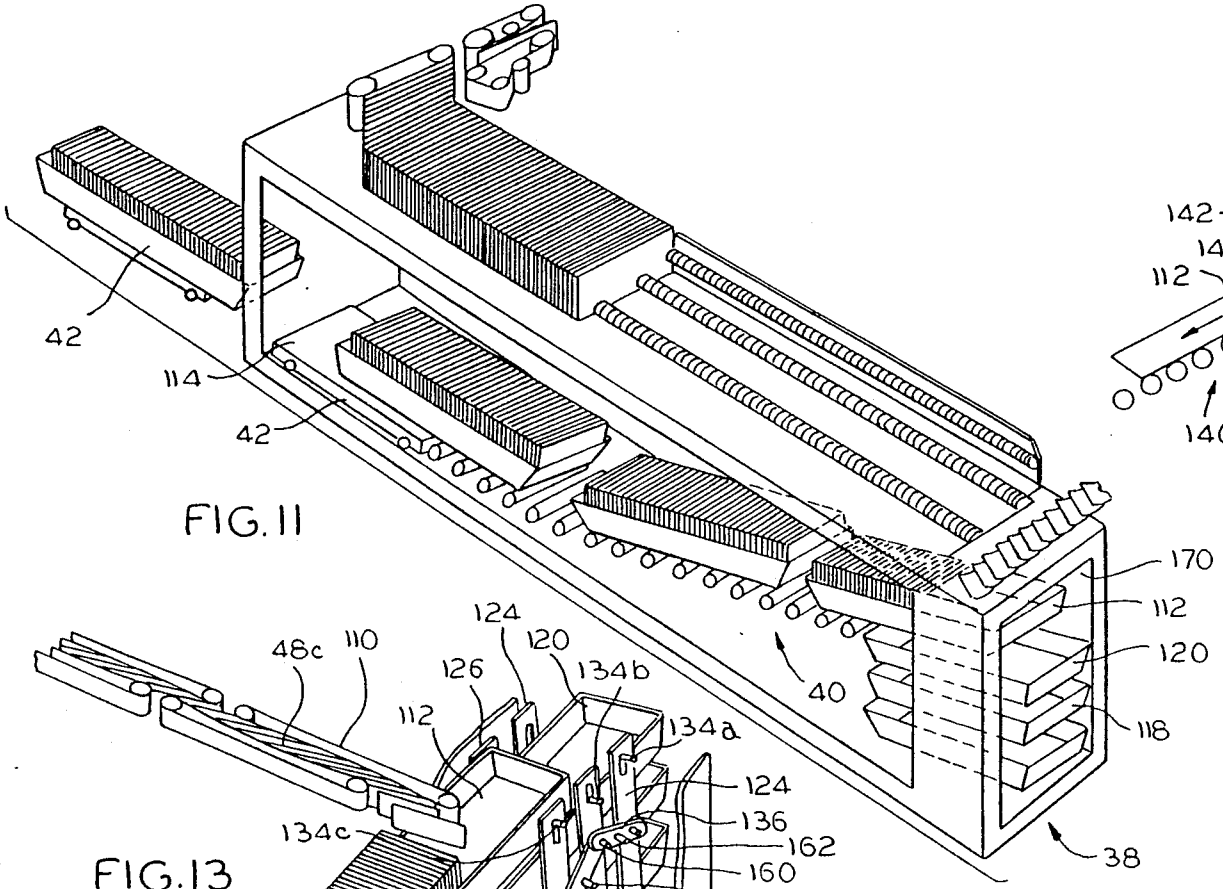
FIG. 11 is a schematic perspective view of a portion of the device of FIG. 1 showing the document input loading elements on the upper level, and the shingled loading of sorted mail into mail trays on the lower level.

It should be pointed out that a mirror image of this string, pins, and linkage configuration exists on the opposite side of the tray raising mechanism. As these raising and lowering actions occur, the strips carry inwardly directed pivoted shelves 140 which are rotatable upwardly as seen in FIG. 14. As tray 112 is discharged by the opening of gate 142, the central strips 126 move downwardly, thereby causing gate 140*a* to flip upwardly, as seen in phantom in FIG. 14, and slide down the side of tray 120 until the shelf 140*a* moves past the bottom of tray 120. The shelf then drops to the horizontal position and permits the strip to move upwardly again whence the outboard shelves 140*b* and 140*c* will do the same thing and the second tray 120 will be in the secure upper position and available for accepting shingled mail. A new tray 116 is introduced in the empty lower position (FIG. 12) and the cycle is then repeated until complete sorting is accomplished.

I claim:

1. An improved document sorting machine, suitable for sorting mail, which comprises in combination; a document input feed means, at least one singulation means for orienting and singulating said documents so that indicia on their faces can be disposed at a predetermined level about a data reference plane, indicia reading means including means for generating indicia indicating signals, electronic/computer means for processing said indicating signals, means for sorting said documents into bins, said sorting means being controlled by said signal generating means after generated signals are interpreted by said electronic/computer means, a plurality of said bins being located in side-by-side array, first elongated belt means disposed along said side-by-side array of bins for moving documents received therefrom, said first elongated belt means having an outboard edge remote from said array of bins, means for moving said documents from said bins onto said first elongated belt means, locating means associated with said first elongated belt means for positioning documents on said first elongated belt means, shingler means for shingling documents received from said first elongated belt means, transport means for moving shingled documents as they are discharged from said shingler means, and loading means for receiving shingled documents and sequentially loading said shingled documents into empty trays.

2. An improved document sorting machine as claimed in claim 1 wherein said locating means includes a second elongated belt means movable with said first elongated belt means, and disposed substantially perpendicular to said first elongated belt means adjacent its outboard edge.

3. An improved document sorting machine as claimed in claim 2 wherein said first elongated belt means is angled downwardly away from said array of bins to cause said documents to orient themselves against said second elongated belt means as a reference plane.

4. An improved document sorting machine as claimed in claim 3 wherein said first elongated belt means conveys a stack of documents from each bin of said array of bins in spaced sequential relationship to said shingler means.

5. An improved document sorting machine as claimed in claim 4 wherein said bins of said array are mechanically tipped to move each said stack of documents out of said bins and onto said first elongated belt means.

6. An improved document sorting machine as claimed in claim 5 wherein said first elongated belt means terminates adjacent a short stack-length belt that is horizontally disposed to receive, align and prepare each stack of documents for introduction into said shingler means.

7. An improved document sorting machine as claimed in claim 6 wherein said shingler means causes each document of each stack of documents to be sequentially overlapped with adjacent documents by an amount of less than 100% of document height, and then to be introduced into said transport means wherein at least one pair of flexible opposed belt means grip the shingled documents as they are discharged from said shingler means.

8. An improved document sorting machine as claimed in claim 7 wherein said gripped shingled documents are delivered to and discharged sequentially into said empty trays by said opposed belt means.

9. An improved document sorting machine as claimed in claim 8 wherein said empty trays are sequentially elevated to an upper loading position by automatic lifting means for lifting them upwardly after a release of a filled one of said trays from said upper loading position.

10. An improved document sorting machine as claimed in claim 9 wherein said automatic means includes a plurality of parallel strip-like means on a supporting structure disposed in spaced relation along opposite walls thereof, and pivotable support means mounted on said strip-like means for underlying and supporting said trays.

11. An improved document sorting machine as claimed in claim 10 wherein said strip-like means are three in number on each of said opposite walls with each central strip-like means being connected to a powered bell crank for vertical up and down movement.

12. An improved document sorting machine as claimed in claim 11 wherein each said central strip-like means is connected to the outboard strips by linkage means for causing movement of each said central strip-like means by said bell crank to result in vertical movement of said outboard strip-like means in an opposite direction.

13. An improved document sorting machine as claimed in claim 12 wherein said bell crank is operable when a filled tray is discharged from said upper loading position.

14. An improved document sorting machine as claimed in claim 13 wherein each said central strip-like means is initially moved downwardly by said bell crank acting through a pivotable yoke attached to said central strip-like means.

15. An improved document sorting machine as claimed in claim 14 wherein downward movement of said central strip-like means causes each said pivotable support means to move about a pivot into a position parallel to said strip-like means to permit each said support means to clear the side of the next lower one of said empty trays, movement below said next lower tray permitting said support means to move downwardly about each said pivot and to underlie the next lower one of said trays, with downward movement of each said central strip-like means causing said outboard strip-like means to move upward, and with upward movement of each said central strip-like means causing the outward strip-like means to move downwardly to cause said support means to also move downwardly along the side walls of said trays and thence to underlie said trays when said support means pass below the plane of the underside of said trays.

16. An improved document sorting machine as claimed in claim 15 wherein said strip-like means include a plurality of axially spaced slot means for accepting fixed pin means extending from said support structure side walls, said linkage including two arms pivotably mounted at their inner ends on each said central strip-like means, fixed pin means intermediate the ends of each said arm extending outwardly toward and engaging said supporting structure side walls, and slot means adjacent free ends of said airs for accepting fixed pin means attached to said outboard strip-like means to cause said outboard strip-like means to move equally and oppositely from each said central strip-like means as said central strip-like means are moved vertically up and down in unison.

17. An improved document sorting machine as claimed in claim 16 wherein said loading means further includes conveyor means for accepting filled ones of said trays when they are discharged from said automatic lifting means, and means for removing said trays from the vicinity of said sorting machine.

18. An improved document sorting machine as claimed in claim 17 wherein said means for removing said trays includes dolly means positioned to accept said filled trays as they progress off the end of said conveyor means.

19. An improved document sorting machine as claimed in claim 3 wherein said documents orient themselves edge-wise against said second elongated belt means.

20. An improved document sorting machine as claimed in claim 2 wherein said second elongated belt means is substantially coterminous in length with said first elongated belt means.

21. An improved document sorting machine as claimed in claim 1 wherein said side-by-side array of bins is a horizontal array.

22. An improved document sorting machine as claimed in claim 1 wherein said locating means positions an edge of said documents on said first elongated belt means along a common plane.

23. An improved document sorting machine as claimed in claim 1 wherein said indicia reading means receives individual documents from said singulation means.

24. An improved document sorting machine, suitable for sorting mail, which comprises a document input feed means for orienting individual documents so that indicia on their faces can be disposed at a predetermined level about a data reference plane, indicia reading means including means for generating indicia indicating signals, means for sorting said individual documents into an array of bins responsive to said signals, first elongated belt means disposed along said array of bins for moving documents received therefrom, means for moving said documents from said bins onto said first elongated belt means, shingler means for shingling documents received from said first elongated belt means, transport means for moving shingled documents as they are discharged from said shingler means, and loading means for receiving shingled documents and sequentially loading said shingled documents into empty trays.

25. An improved document sorting machine as claimed in claim 21 further comprising a locating means including a second elongated belt means movable with said first elongated belt means, and disposed substantially perpendicular to said first elongated belt means adjacent an outboard edge of said first belt means.

26. An improved document sorting machine as claimed in claim 25 wherein said first elongated belt means is angled downwardly away from said array of bins to cause said documents to orient themselves against said second elongated belt means as a reference plane.

27. An improved document sorting machine as claimed in claim 26 wherein said documents orient themselves edge-wise against said second elongated belt means.

28. An improved document sorting machine as claimed in claim 26 wherein said first elongated belt means conveys a stack of documents from each bin of said array of bins in spaced sequential relationship to said shingler means.

29. An improved document sorting machine as claimed in claim 28 wherein said bins of said array are mechanically tipped to move each said stack of documents out of said bins and onto said first elongated belt means.

30. An improved document sorting machine as claimed in claim 29 wherein said first elongated belt means terminates adjacent a short stack-length belt that is horizontally disposed to receive, align and prepare each stack of documents for introduction into said shingler means.

31. An improved document sorting machine as claimed in claim 30 wherein said shingler means causes each document of each stack of documents to be sequentially overlapped with adjacent documents by an amount of less than 100% of document height, and then to be introduced into said transport means wherein at least one pair of flexible opposed belt means grip the shingled documents as they are discharged from said shingler means.

32. An improved document sorting machine as claimed in claim 31 wherein said gripped shingled documents are delivered to and discharged sequentially into said empty trays by said opposed belt means.

33. An improved document sorting machine, suitable for sorting mail, which comprises in combination; a document input feed means, at least one singulation means for orienting and singulating said documents so that indicia on their faces can be disposed at a predetermined level about a data reference plane, indicia reading means including means for generating indicia indicating signals, means for sorting individual documents into an array of bins responsive to said signals, first elongated belt means disposed along said array of bins for moving documents received therefrom, means for moving said documents from said bins onto said first elongated belt means, shingler means for shingling documents received from said bins, means for moving shingled documents as they are discharged from said shingler means, and means for receiving shingled documents and sequentially loading said shingled documents into empty trays.

34. An improved sorting machine as claimed in claim 33 further comprising locating means including a second elongated belt means movable with said first elongated belt means, and disposed substantially perpendicular to said first elongated belt means adjacent its outboard edge remote from said bins.

35. An improved sorting machine as claimed in claim 34 wherein said first elongated belt means is angled downwardly away from said array of bins to cause said documents to orient themselves against said second elongated belt means as a reference plane.

36. An improved sorting machine as claimed in claim 35 wherein said documents orient themselves edge-wise against said second elongated belt means.

37. An improved sorting machine as claimed in claim 35 wherein said first elongated belt means conveys a stack of documents from each bin of said array of bins in spaced sequential relationship to said shingler means.

38. An improved sorting machine as claimed in claim 37 wherein said bins of said array are mechanically tipped to move each said stack of documents out of said bins and onto said first elongated belt means.

* * * * *